US008485640B2

(12) United States Patent
Oya et al.

(10) Patent No.: US 8,485,640 B2
(45) Date of Patent: Jul. 16, 2013

(54) NOZZLE PLATE, DROPLET DISCHARGE HEAD, METHOD FOR MANUFACTURING THE SAME AND DROPLET DISCHARGE DEVICE

(75) Inventors: Kazufumi Oya, Suwa (JP); Katsuji Arakawa, Chino (JP)

(73) Assignee: Seiko Epson Corporation (JP)

( * ) Notice: Subject to any disclaimer, the term of this patent is extended or adjusted under 35 U.S.C. 154(b) by 1349 days.

(21) Appl. No.: 12/120,403

(22) Filed: May 14, 2008

(65) Prior Publication Data

US 2008/0309718 A1 Dec. 18, 2008

(30) Foreign Application Priority Data

Jun. 18, 2007 (JP) ..... 2007-159811

(51) Int. Cl.
*B41J 2/14* (2006.01)

(52) U.S. Cl.
USPC ..... 347/47

(58) Field of Classification Search
USPC ..... 347/47
See application file for complete search history.

(56) References Cited

U.S. PATENT DOCUMENTS 6,663,231 B2 * 12/2003 Lee et al. ..... 347/68

FOREIGN PATENT DOCUMENTS

| | | |
|---|---|---|
| JP | 56-135075 | 10/1981 |
| JP | 10-315461 | 12/1998 |
| JP | 11-028820 | 2/1999 |
| JP | 2000-203030 | 7/2000 |
| JP | 2001-287369 | 10/2001 |
| JP | 2002-2054041 | 7/2002 |
| JP | 2006-045656 | 2/2006 |
| JP | 2007-055241 | 3/2007 |
| JP | 2007-320254 | 12/2007 |

* cited by examiner

*Primary Examiner* — Kevin S Wood
(74) *Attorney, Agent, or Firm* — Harness, Dickey & Pierce, P.L.C.

(57) ABSTRACT

A nozzle plate includes a silicon substrate, and a nozzle hole formed in the silicon substrate for discharging a liquid droplet provided with: a first nozzle portion formed perpendicularly to a surface of the silicon substrate; a second nozzle portion formed on a same axis as an axis of the first nozzle portion and having a cross-sectional area that is larger than a cross-sectional area of the first nozzle portion; and an inclined portion having a cross-sectional area gradually increasing from the first nozzle portion to the second nozzle portion.

5 Claims, 11 Drawing Sheets

ANISOTROPIC DRY ETCHING
(NOZZLE SHAPE IN FIG. 8L)

ANISOTROPIC WET ETCHING
(NOZZLE SHAPE IN FIG. 8M)

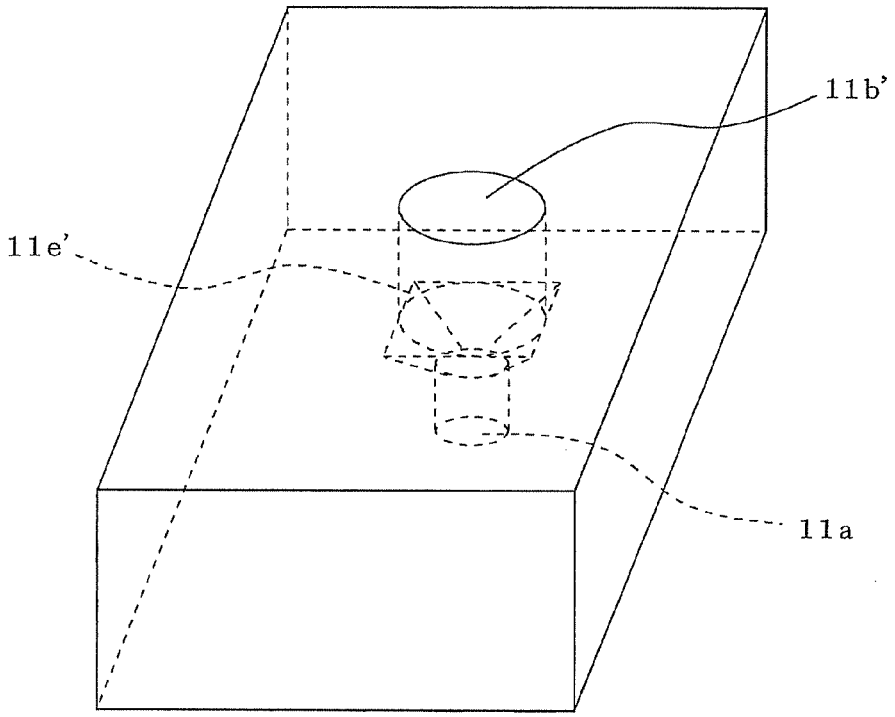
FIG.12A A CASE WHERE A NOZZLE SHAPE IN RELATED ART IS ANISOTROPICALLY DRY ETCHED
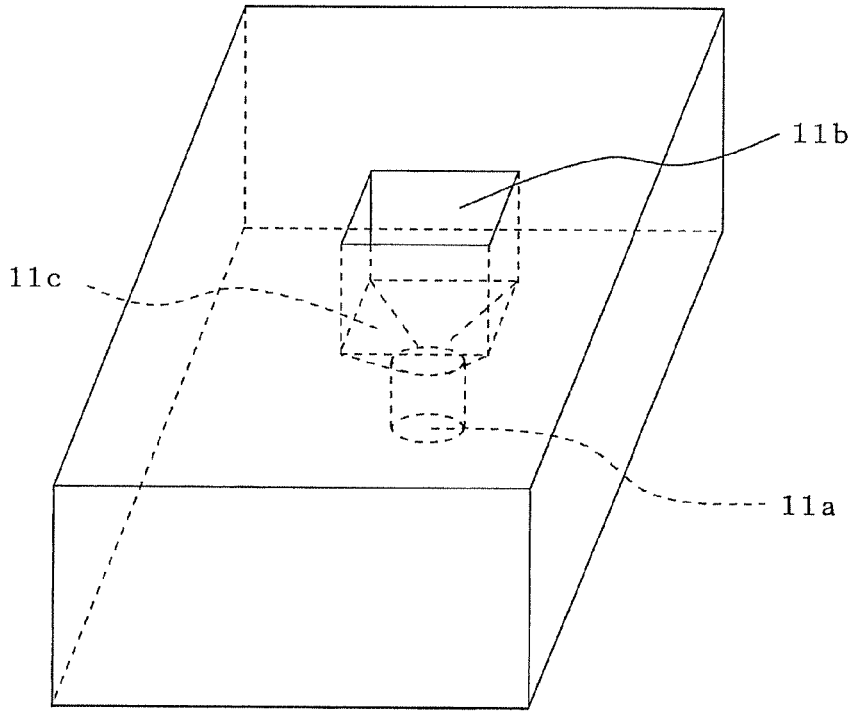
FIG.12B NOZZLE SHAPE ACCORDING TO AN EMBODIMENT OF THE PRESENT INVENTION

NOZZLE PLATE, DROPLET DISCHARGE HEAD, METHOD FOR MANUFACTURING THE SAME AND DROPLET DISCHARGE DEVICE

BACKGROUND

1. Technical Field

The present invention relates to a nozzle plate and a droplet discharge head that are used in an inkjet head or the like, a method for manufacturing them, and a droplet discharge device.

2. Related Art

An inkjet head installed in an inkjet recording system generally includes a nozzle plate having a plurality of nozzle holes formed therein for discharging ink droplets, and a cavity plate having a discharge chamber bonded to the nozzle plate so as to communicate with the nozzle holes in the nozzle plate, and an ink flow path such as a reservoir. The inkjet head discharges an ink droplet from a selected nozzle hole by applying pressure to the discharge chamber from a driving section. Examples of driving systems include a system using an electrostatic force, a piezoelectric system using piezoelectric elements, and a system using heater elements.

In recent years, there has been an increasing demand for high quality in printing, images and the like. Therefore, high densification of nozzles and improvement in discharging performance have been attempted by arranging a plurality of nozzle rows, increasing the number of nozzles per row, extending the row of the nozzles, and so on. According to such a background, various innovations and suggestions have been made concerning a nozzle portion of the inkjet head.

For example, JP-A-56-135075 (FIG. 2) discloses forming a nozzle in a pyramid shape penetrating a silicon substrate having a (100) surface orientation by anisotropic wet etching.

JP-A-2006-45656 (FIGS. 4 and 16) discloses forming a nozzle in a tapered shape in a silicon substrate by alternately performing an isotropic dry etching and an anisotropic dry etching.

JP-A-10-315461 (FIGS. 1 and 2) discloses forming a tapered nozzle portion in a silicon substrate having a (100) surface orientation without penetrating, and then forming a perpendicular nozzle portion in a cylindrical shape penetrating the silicon substrate by anisotropic dry etching from the other surface of the silicon substrate.

JP-A-2000-203030 (FIG. 1) discloses forming an etch pit in a silicon substrate having a (110) surface orientation by anisotropic wet etching, and then forming a nozzle by anisotropic wet etching while the silicon substrate is soaked in an electrolyte solution and a reverse bias voltage is applied.

JP-A-11-28820 (FIGS. 3 and 4) discloses forming a nozzle having two stages in which a first nozzle portion in a cylindrical shape with a small diameter and a second nozzle portion in a cylindrical shape with a large diameter are formed in a silicon substrate having a (100) surface orientation by anisotropic dry etching.

However, techniques disclosed in JP-A-56-135075 (FIG. 2), JP-A-2006-45656 (FIGS. 4 and 16), JP-A-10-315461 (FIGS. 1 and 2), JP-A-2000-203030 (FIG. 1), and JP-A-11-28820 (FIGS. 3 and 4) described above have issues to be described below.

In JP-A-56-135075 (FIG. 2), since the nozzle is formed by anisotropic wet etching, an inclination angle of a tapered potion of the nozzle depends on a surface orientation of the silicon single crystal substrate. Therefore, increasing the nozzle density is limited. Further, an end of the nozzle becomes in a square shape due to the surface orientation of the silicon, making it hard to maintain a droplet straight flying property. Furthermore, since a discharge outlet of the nozzle does not have a perpendicular portion, it is hard to stably maintain a meniscus.

In JP-A-2006-45656 (FIGS. 4 and 16), undercuts in sidewalls of the nozzle proceed due to isotopic dry etching, causing difficulty in controlling a diameter of the nozzle. Further, since a discharge outlet of the nozzle does not have a perpendicular portion, it is hard to stably maintain a meniscus.

In JP-A-10-315461 (FIGS. 1 and 2), since the tapered nozzle portion is formed by anisotropic wet etching, an inclination angle of the tapered potion of the nozzle depends on a surface orientation of the silicon single crystal substrate. Therefore, increasing the nozzle density is limited. Further, since alignment of both sides of the tapered portion and the perpendicular portion of the nozzle is required, accuracy is inferior to a case where alignment is performed from one side to be processed.

In JP-A-2000-203030 (FIG. 1), since a tapered portion of the nozzle is formed by anisotropic wet etching, an inclination angle of the tapered potion of the nozzle depends on a surface orientation of the silicon single crystal substrate. Therefore, increasing the nozzle density is limited. Further, a border of the tapered portion and a perpendicular portion of the nozzle becomes indefinite, making it difficult to adjust a flow path resistance of the nozzle, that is, to adjust a length of the nozzle.

In JP-A-11-28820 (FIGS. 3 and 4), there is a stepped portion in a cylindrical shape between the first nozzle portion and the second nozzle portion, and thus stagnation of the ink flow occurs at the stepped portion, causing issues such as disturbance of flow and increase of a flow path resistance.

SUMMARY

An advantage of the invention is to provide a nozzle plate, a droplet discharge head, a method for manufacturing the same, and a droplet discharge device that can improve discharge characteristics and increase nozzle density.

A nozzle plate according to a first aspect of the invention includes a silicon substrate, and a nozzle hole formed in the silicon substrate for discharging a liquid droplet. The nozzle hole is provided with a first nozzle portion formed perpendicularly to a surface of the silicon substrate, a second nozzle portion formed on a same axis as an axis of the first nozzle portion and having a cross-sectional area that is larger than a cross-sectional area of the first nozzle portion, and an inclined portion having a cross-sectional area gradually increasing from the first nozzle portion to the second nozzle portion.

In the nozzle shape and nozzle structure as the above, the first nozzle portion and the second nozzle portion are joined through the inclined portion without a stepped portion, preventing turbulence of the ink flow and enabling the ink flow to be aligned to discharge in a central axis direction of the nozzle hole. Therefore, discharge characteristics are improved.

In this case, the cross-sectional area of the second nozzle portion and the cross-sectional area of the inclined portion are preferably shaped in one of a square shape and a rectangular shape.

The cross-sectional area of the second nozzle portion and the cross-sectional area of the inclined portion are in a shape that is not restricted by a crystal orientation of silicon, thereby enabling high densification of nozzles.

A method for manufacturing a nozzle plate according to a second aspect of the invention includes: forming a nozzle hole in a silicon substrate by anisotropic dry etching, the nozzle hole including a first nozzle perpendicular to a surface of the silicon substrate, and a second nozzle formed on a same axis as an axis of the first nozzle portion and having a cross-sectional area that is larger than a cross-sectional area of the first nozzle portion and shaped in a polygonal shape; forming a protection film on a whole of an inner wall of the nozzle hole; selectively removing the protective film formed on a stepped portion between the first nozzle portion and the second nozzle portion; and forming an inclined portion by anisotropic wet etching so that the inclined portion has a cross-sectional area gradually reducing from the second nozzle portion to the first nozzle portion.

In the method for manufacturing a nozzle plate, the nozzle hole provided with the first nozzle portion and the second nozzle potion having the cross-sectional area in a polygonal shape are formed by anisotropic dry etching, followed by the protection film forming on the whole of the inner wall of the nozzle hole. Then, after the protection film formed on the stepped portion between the first nozzle portion and the second nozzle portion is selectively removed, the stepped portion is formed to incline by anisotropic wet etching. Accordingly, the nozzle plate that can achieve improvement in discharge characteristics and high densification of nozzles is manufactured at low cost.

In this case, the protective film formed on the stepped portion may be removed by anisotropic dry etching. Further, the protective film formed on the inner wall of the nozzle hole is preferably a thermal oxide film. Furthermore, in order to form the stepped portion so as to incline by anisotropic wet etching, a single crystal silicon substrate having a (100) surface orientation is preferably used since it is orthogonal to a surface having a (111) crystal orientation to which at least four sides among sides shaping the cross-sectional area of the inclined portion are parallel.

A droplet discharge head according to a third aspect of the invention is provided with any of the nozzle plates described above, achieving improvement in discharge characteristics and high densification of nozzles.

A method for manufacturing a droplet discharge head according to a fourth aspect of the invention employs any of the methods for manufacturing a nozzle described above to manufacture a droplet discharge head, enabling fabrication of a droplet discharge head that can achieve improvement in discharge characteristics and high densification of nozzles.

A droplet discharge device according to a fifth aspect of the invention is provided with the droplet discharge head described above, thereby achieving improvement in discharge characteristics and high densification of nozzles.

BRIEF DESCRIPTION OF THE DRAWINGS

The invention will be described with reference to the accompanying drawings, wherein like numbers reference like elements.

FIG. 4A is a back view and FIG. 4B is a sectional view taken along the line A-A in FIG. 4A.

FIGS. 12A and 12B are diagrams explaining a case where a method of the invention is performed on a nozzle in a shape according to related art and a nozzle in a shape according to the embodiment of the invention.

DESCRIPTION OF EXEMPLARY EMBODIMENTS

An embodiment of a droplet discharge head provided with a nozzle plate according to the invention will be described with reference to the accompanying drawings. Here, as an example of the droplet discharge head, an inkjet head in an electrostatic drive system is described referring to FIGS. 1 through 4B. The invention is not limited to the structure and shape shown in the figures below except for the nozzle shape. Further, the invention can be applicable not only to a face discharge type, but also an edge discharge type. Furthermore, since the drive system is not an exception, the invention is also applicable to a droplet discharge head and a droplet discharge device for discharging a droplet driven by any other drive systems.

Figure 1:
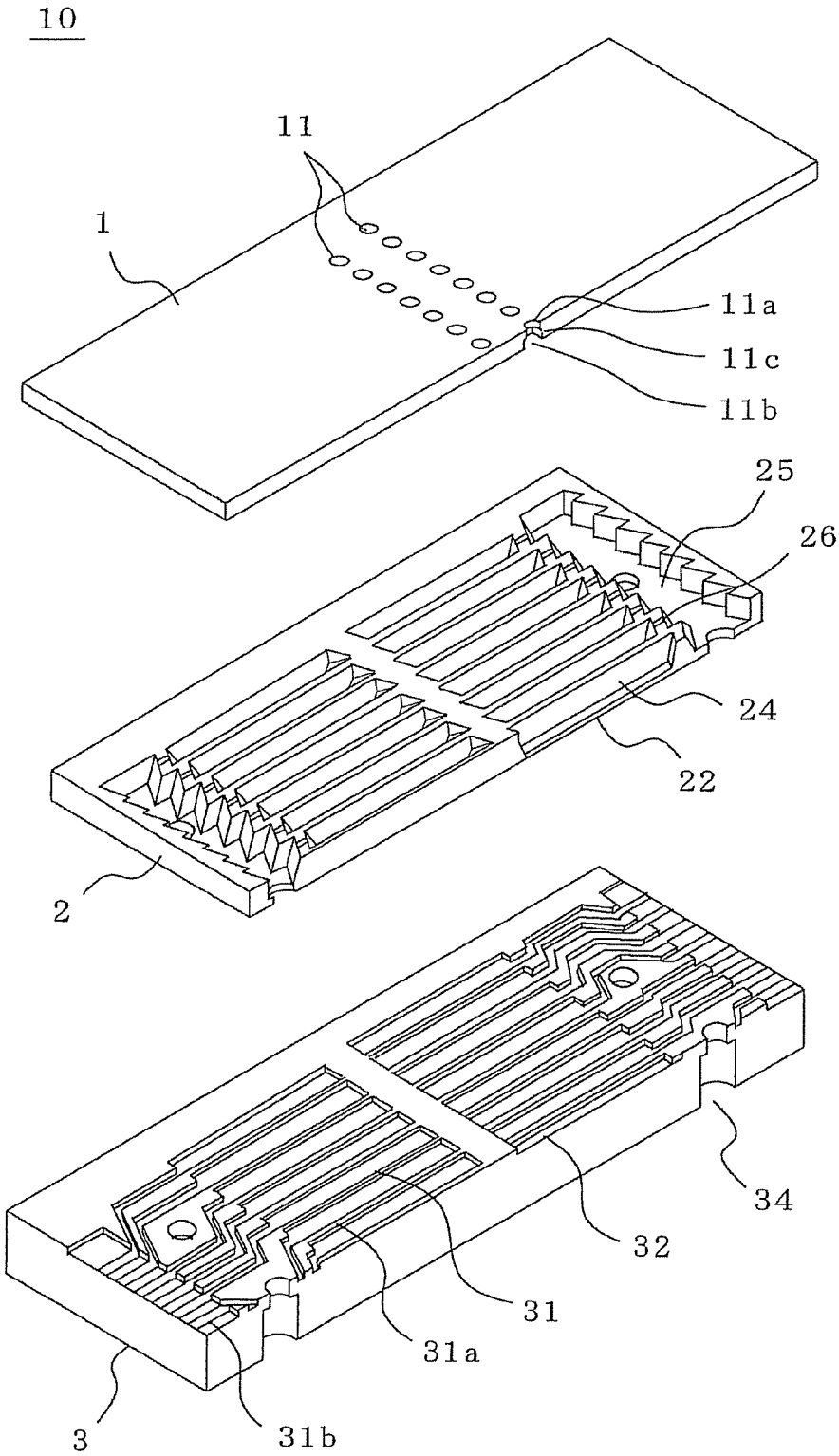
FIG. 1 is an exploded perspective view showing a schematic structure of an inkjet head according to an embodiment of the invention.
Figure 2:
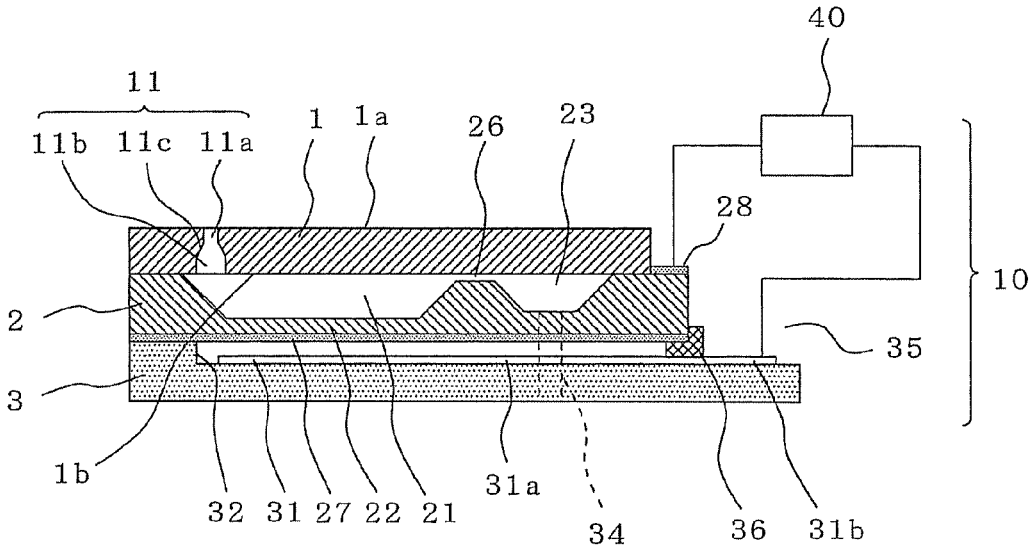
FIG. 2 is a partial sectional view of the inkjet head showing the schematic structure of a right half of FIG. 1 in an assembly state.
Figure 3:
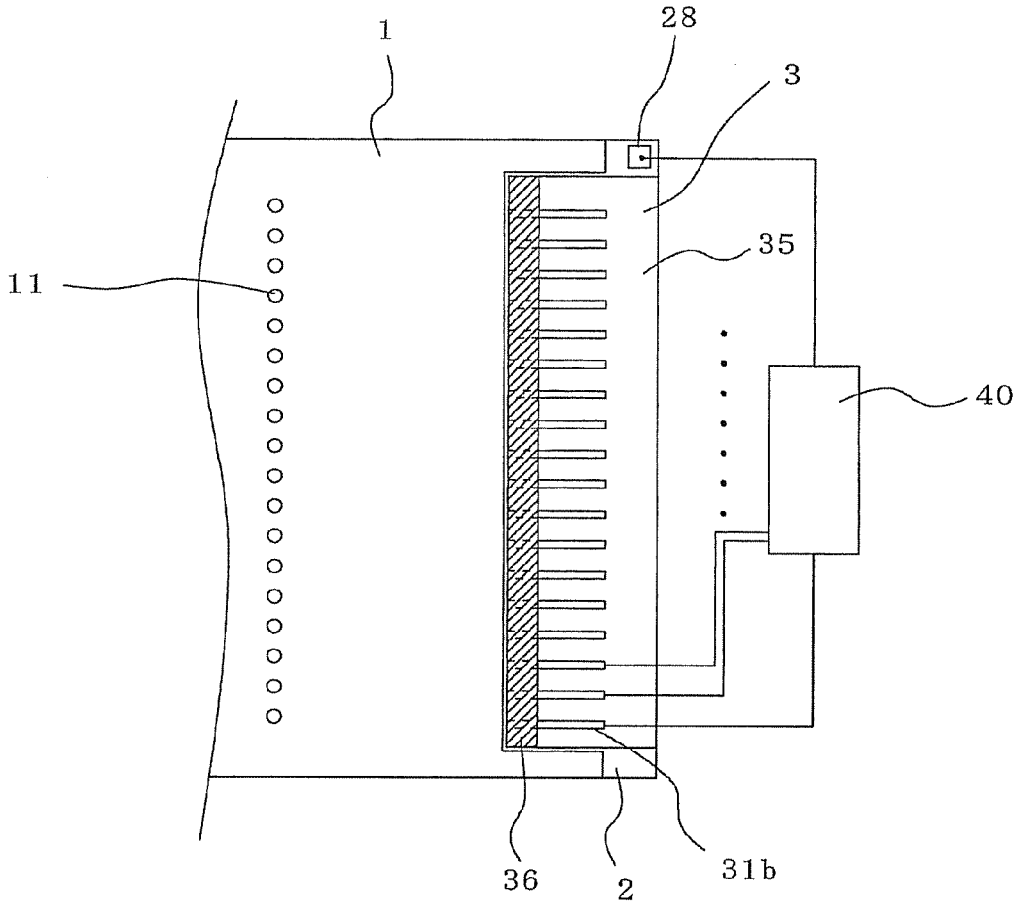
FIG. 3 is a top view of the inkjet head in FIG. 2.
Figure 4A:
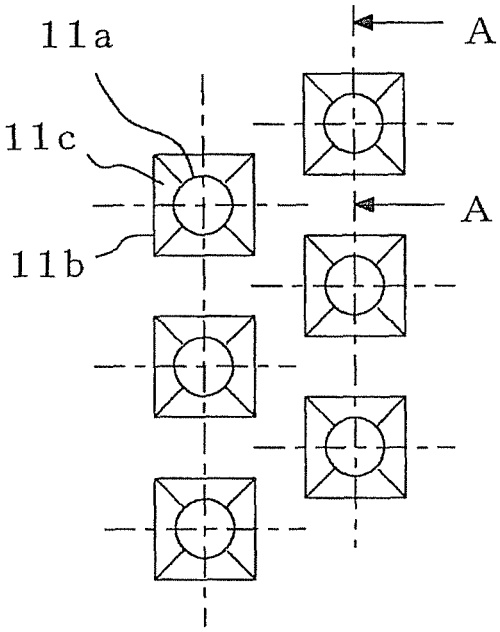
FIGS. 4A and 4B are enlarged views illustrating an example of a nozzle shape.
Figure 4B:
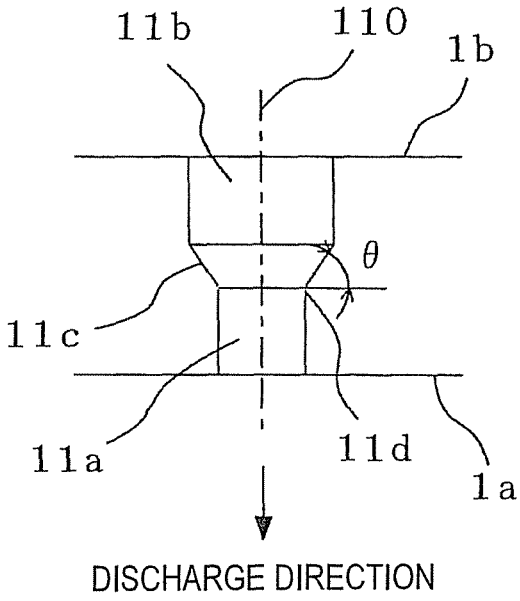

FIG. 1 is an exploded perspective view shown by disassembling a schematic structure of an inkjet head according to an embodiment, in which a part thereof is shown in section. FIG. 2 is a sectional view of the inkjet head showing the schematic structure of a right half of FIG. 1 in an assembly state, while FIG. 3 is a top view of the inkjet head shown in FIG. 2. Further, FIGS. 4A and 4B are enlarged views illustrating an example of a nozzle shape. FIG. 4A is a back view of the nozzle plate seen from the bottom and FIG. 4B is a sectional view taken along the line A-A in FIG. 4A.

An inkjet head 10 according to the embodiment is configured, as shown in FIGS. 1 and 2, by bonding together a nozzle plate 1 in which a plurality of nozzle holes 11 are formed at a predetermined pitch, a cavity plate 2 in which an ink supply path is formed independently with respect to each of the nozzle holes 11, and an electrode substrate 3 on which an individual electrode 31 is disposed opposing a vibration plate 22 disposed on the cavity plate 2.

The nozzle plate 1 is, for example, made of a single crystal silicon substrate with a (100) surface orientation. Here, each of the nozzle holes 11 for discharging ink droplets includes a first nozzle portion 11*a*, a second nozzle portion 11*b*, and an inclined portion 11*c*. The first nozzle portion 11*a* is formed in a cylindrical shape having a minor diameter perpendicularly to a surface 1*a* (ink discharging surface) of the nozzle plate 1, while the second nozzle portion 11*b* is formed on the same axis as that of the first nozzle portion 11*a*. The second nozzle portion 11*b* has a cross-sectional area that is larger than that of the first nozzle portion 11*a*, and is formed in a polygonal shape such as a square, for example. The inclined portion 11*c* is formed so that the cross-sectional area gradually increases from the first nozzle portion 11*a* to the second nozzle portion 11*b*. Therefore, the first nozzle portion 11*a* and the second nozzle portion 11*b* are joined smoothly from the second nozzle portion 11*b* having a polygonal cross-sectional area to the first nozzle portion 11*a* having a circular cross-sectional area through the inclined portion while the cross-sectional area is gradually reduced without any step portions therebetween.

A flow path resistance of the nozzle is defined by a bore diameter and length of the first nozzle portion 11*a*. A joined position 11*d* of the first nozzle portion 11*a* and the inclined portion 11*c* (refer to FIG. 4B) is defined when a size of the second nozzle portion 11*b* is unambiguously defined by an angle θ of the surface orientation of the single silicon substrate. Therefore, a length of the first nozzle portion 11*a* (nozzle length) is precisely adjustable by grounding or etching the thickness of the single crystal substrate, that is the surface of the substrate (ink discharging surface) 1*a*. Here, a cross sectional shape of the inclined portion 11*c* is circular at the joined position 11*d*.

The nozzle hole 11 in the shape and structure described above can allow the second nozzle portion 11*b* to rectify an ink flow that flows in, and allow the inclined portion 11*c* to lead the ink flow smoothly in the direction of a nozzle central axis 110. Since the first nozzle portion 11*a* is a perpendicular portion in a cylindrical shape, an ink droplet is discharged straightforward in the direction of the nozzle central axis 110 while a meniscus is stably maintained.

Therefore, there are no step portions or the like between the first nozzle portion 11*a* and the second nozzle portion 11*b*, thereby not causing stagnation. As a result, an ink droplet in a stable amount of the ink can be discharged straightforward in the direction of the nozzle central axis 110.

Figure 5:
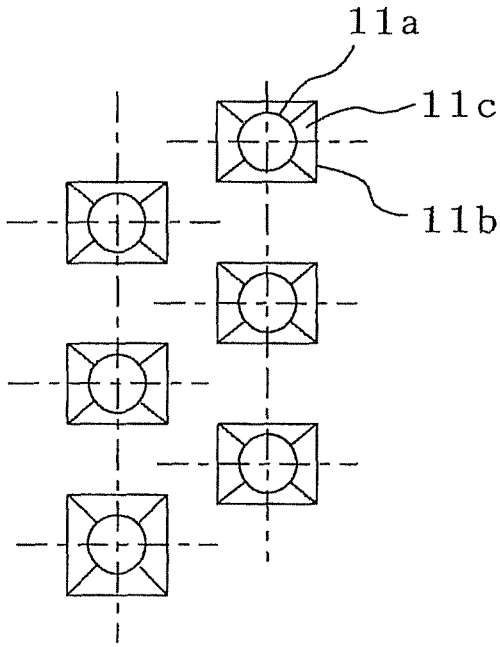
FIG. 5 is an enlarged view showing another example of the nozzle shape.

The cross-sectional shape of the second nozzle portion 11*b* is formed in a square shape as shown in FIG. 4A. However, the shape is not limited to a square shape, but can be formed in a rectangular shape as shown in FIG. 5. In this case, if long sides of the rectangular shape are arranged so as to be orthogonal to a direction of the nozzle rows, a nozzle pitch can be further reduced and nozzle density is improved, thereby increasing the number of the nozzles per row. That is, the nozzles can be arranged in a large number and long.

Further, the first nozzle portion 11*a* in a cylindrical shape can be a small circular hole that is equal to or smaller than an inscribed circle inscribed in the square shape or the long sides of the rectangular shape of the second nozzle portion 11*b*.

Therefore, according to the structure of the nozzle holes 11 of the embodiment, both improvement in performance of the flow path characteristics of the nozzles and high densification are achieved.

The cavity plate 2 is, for example, made of a single crystal silicon substrate with a (110) surface orientation. The silicon substrate is anisotropically wet etched so as to form recessed portions 24 and 25 into compartments to form a discharge chamber 21 and a reservoir 23 of the ink flow path. The nozzle plate 1 described above is bonded onto the cavity plate 2, then ink flow paths that respectively communicate with the nozzle holes 11 are formed into compartments between the nozzle plate and the cavity plate 2 as shown in FIG. 2. Then, a bottom wall of the discharge chamber 21 (recessed portion 24) serves as a vibration plate 22.

The other recessed portion 25 pools ink that is a liquid material and forms the reservoir (common ink chamber) 23, which is communicated with the discharge chamber 21 in common. Then, the reservoir 23 (recessed portion 25) communicates with the discharge chamber 21 via an orifice 26 that is a narrow ditch. In addition, a bottom portion of the reservoir 23 has a hole formed to penetrate through the electrode substrate 3 described below. Through an ink supplying hole 34 of the hole, ink is supplied from an ink tank (not shown in the drawings). The orifice 26 can be formed on a back surface of the nozzle plate 1, that is, a bonding surface 1*b* that will be bonded to the cavity plate 2.

Further, on a whole surface of the cavity plate 2 or at least a surface thereof opposing to the electrode plate 3, an insulation film 27 made of a $SiO_2$ film, or so-called a high-k material (high permittivity gate insulation film) is formed by a thermal oxidation method or plasma chemical vapor deposition (CVD) using tetraethylorthosilicate (TEOS; tetraethoxysilane) as a material gas. The insulation film 27 is formed to prevent dielectric breakdown or short circuit upon an operation of the inkjet head.

The electrode plate 3 to be bonded to a lower side of the cavity plate 2 is, for example, made of a glass substrate about 1 mm thick. The electrode plate 3 has a recessed portion 32 formed on a position opposing to the vibration plate 22 of the cavity plate 6 and having a predetermined depth by etching. Further, inside the recessed portion 32, in general, the individual electrode 31 made of indium tin oxide (ITO) is formed, for example, with a thickness of 0.1 μm by sputtering. Therefore, a gap (void) having a predetermined spacing is formed between the vibration plate 22 and the individual electrode 31.

The individual electrode 31 includes a lead portion 31*a*, and a terminal portion 31*b* coupled to a flexible wiring substrate (not shown in the drawings). The terminal portion 31*b* is exposed to an inside of an electrode outlet 35 in which an end portion of the cavity plate 2 is opened for wiring.

The nozzle plate 1, the cavity plate 2, and the electrode plate 3, which are formed as described above, are bonded together as shown in FIG. 2, providing a main body of the inkjet head 10. In other words, the cavity plate 2 and the electrode plate 3 are bonded together by anodic bonding, and the nozzle plate 1 is bonded to a top surface of the cavity plate 2 by adhesion. Furthermore, an open end portion of the gap formed between the vibration plate 22 and the individual electrode 31 is airtightly sealed with a sealant 36 made of epoxy based resin or the like. This can prevent entry of moisture, dust or the like into the gap, so that the inkjet head 10 can maintain its high reliability.

Then lastly, as simplistically shown in FIGS. 2 and 3, the flexible wiring substrate (not shown in drawings) provided with a driving control circuit 40 such as a driver IC is coupled to the terminal portion 31*b* of the individual electrode 31 and a common electrode 28 formed on the top surface of the cavity plate 2 using an electrically conductive adhesive or the like.

As described above, the inkjet head 10 is completed.

Next, a description will be given of operations of the inkjet head 10 formed as above.

Ink fills up the reservoir 23 through an end of each of the nozzle holes 11 in the nozzle plate 1 without generating air bubbles in each of the ink flow paths.

When printing is performed, the driving control circuit 40 such as a drive IC selects nozzles. If a predetermined pulse voltage is applied to between the vibration plate 22 and the individual electrode 31, electrostatic attractive force is generated, causing deflection of the vibration plate 22 by being attracted toward the individual electrode 31. Then, the vibration plate 22 comes in contact with the individual electrode 31, generating negative pressure in the discharge chamber 21. According to the above, ink in the reservoir 23 is aspirated into the discharge chamber 21 through the orifice 26, generating vibration of ink (meniscus oscillation). When the voltage is released at a point in time in which the vibration of ink becomes approximately maximum, the vibration plate 22 is separated from the individual electrode 31 and pushes out ink from the nozzle hole 11 by resilience of the vibration plate 22 at that time so as to discharge an ink droplet toward a recording paper (not shown).

Next, a method for manufacturing the inkjet head 10, here mainly a method for manufacturing the nozzle plate 1 will be explained with reference to FIGS. 6A to 10X. FIGS. 6A through 10X are partial sectional views showing steps for manufacturing the nozzle plate 1.

Figure 6A:
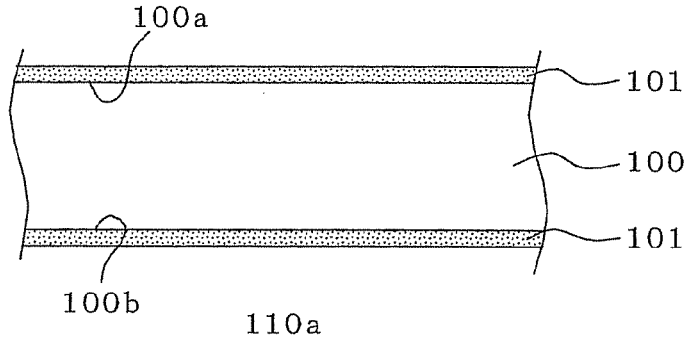
FIGS. 6A through 6E are partial sectional views showing steps for manufacturing a nozzle plate.

(a) First, as shown in FIG. 6A, a single crystal silicon substrate 100 having a thickness of 280 μm and a (100) surface orientation is prepared, and then a thermal oxide film ($SiO_2$ film) 101 having a film thickness of 1 μm is evenly formed on a whole surface of the silicon substrate 100. The $SiO_2$ film 101 is formed by arranging the silicon substrate 100 in a thermal oxidation device and thermally oxidizing it at an oxidation temperature of 1075 degrees Celsius under a mixed atmosphere of oxygen and moisture for four hours. The $SiO_2$ film 101 is used as an etching resistant material for silicon.

Figure 6B:
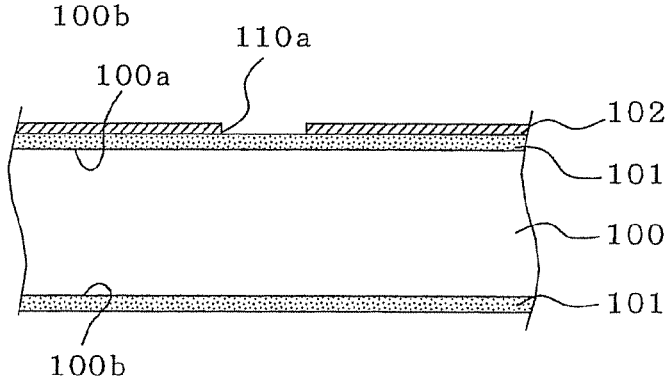

(b) Next, as shown in FIG. 6B, on the $SiO_2$ film 101 of one side of the silicon substrate 100, that is a surface 100*a* to be bonded (bonding surface) to the cavity plate 2, is coated with a resist film 102, and then a polygonal portion 110*a* (e.g. a portion to be in a square shape) to be the second nozzle portion 11*b* of the nozzle hole 11 is patterned.

Figure 6C:
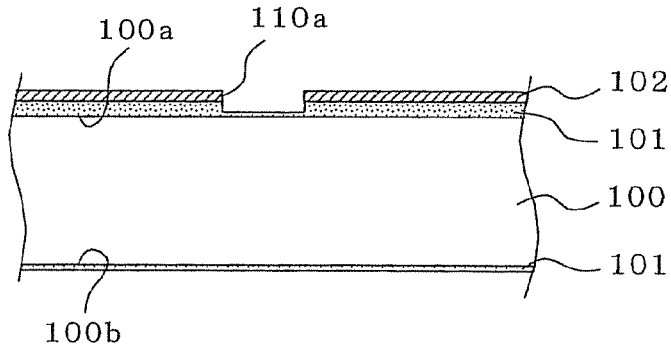

(c) Then, as shown in FIG. 6C, the $SiO_2$ film 101 is half etched by a buffered hydrofluoric acid solution made of an aqueous hydrofluoric acid solution and an ammonium fluoride solution mixed at a ratio of 1:6 so as to thin the $SiO_2$ film 101 of the polygonal portion 110*a* to be the second nozzle portion 11*b*. At this time, the $SiO_2$ film 101 on an ink discharge surface 100*b* is also etched, so that the thickness of the $SiO_2$ film 101 is reduced.

Figure 6D:
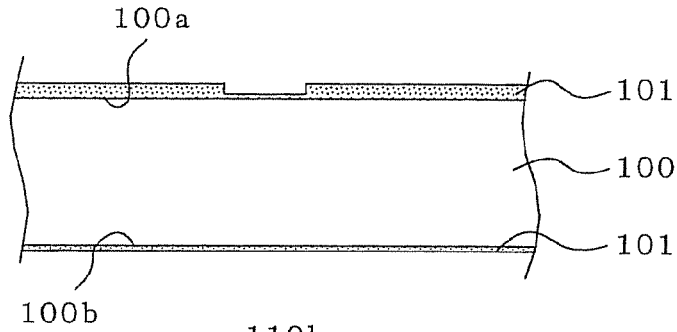

(d) Subsequently, as shown in FIG. 6D, the resist film 102 described above is removed by cleaning with sulfuric acid or the like.

Figure 6E:
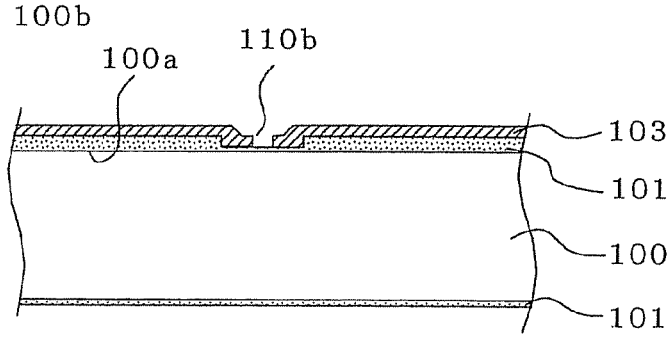

(e) Next, as shown in FIG. 6E, a resist film 103 is applied to coat the bonding surface 100*a* of the silicon substrate 100 again, and then a small circular portion 110*b* to be the first nozzle portion 11*a* of the nozzle hole 11 is patterned.

Figure 7F:
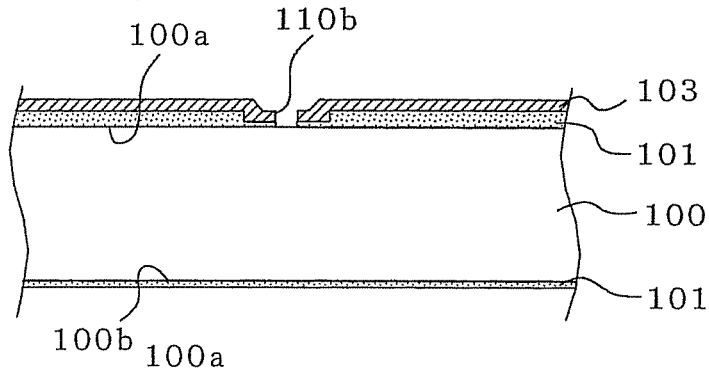
FIGS. 7F through 7J are partial sectional views showing steps for manufacturing the nozzle plate after FIG. 6E.

(f) Then, as shown in FIG. 7F, the $SiO_2$ film 101 is dry etched with a reactive ion etching (RIE) device so as to open the $SiO_2$ film 101 in the small circular portion 110*b* to be the first nozzle portion 11*a*.

The $SiO_2$ film 101 in the small circular portion 110*b* to be the first nozzle portion 11*a* is opened by dry etching, improving a precision of the nozzle diameter more than a case of wet etching.

Figure 7G:
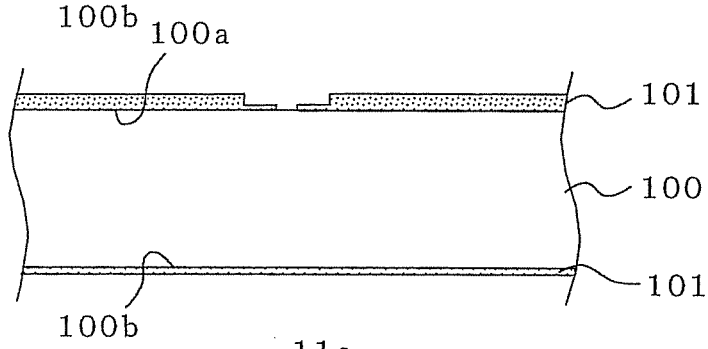

(g) Subsequently, as shown in FIG. 7G, the resist film 103 formed on the bonding surface 100*a* of the silicon substrate 100 is removed by cleaning with sulfuric acid or the like.

Figure 7H:
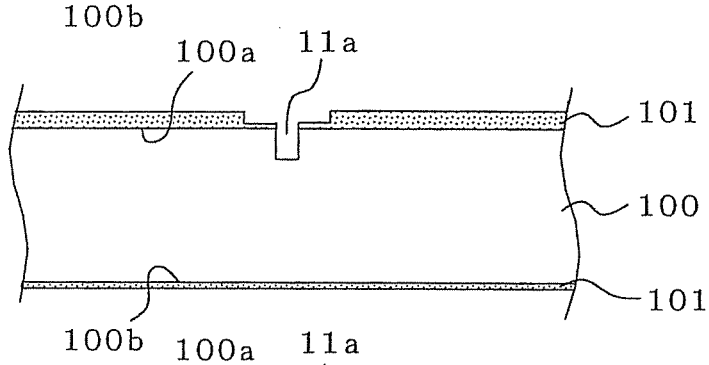

(h) Then, as shown in FIG. 7H, the opening of the $SiO_2$ film 101 is anisotropically dry etched in a perpendicular direction to be 50 μm depth with an inductively coupled plasma (ICP) dry etching device, for example, so as to form the first nozzle portion 11*a* that is a circular hole. In this case, as etching gases, for example, $C_4F_8$ (carbon fluoride) and $SF_6$ (sulfur fluoride) can be alternately used. Here, $C_4F_8$ is used to protect sides of the circular hole so as not to let the etching proceed in a direction of the side of the circular hole, while $SF_6$ is used so as to accelerate the etching in the perpendicular direction of the circular hole.

Figure 7I:
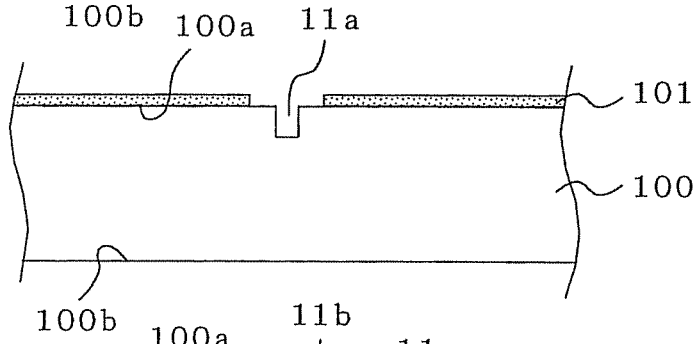

(i) Next, as shown in FIG. 7I, the $SiO_2$ film 101 is half etched with the buffered hydrofluoric acid solution so as to only remove the $SiO_2$ film 101 in a square hole shape to be the second nozzle portion 11*b*.

Figure 7J:
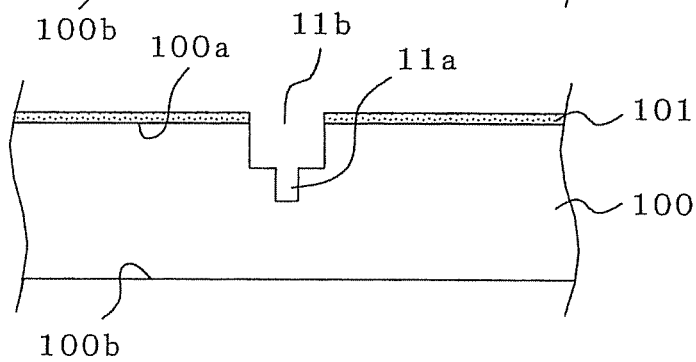

(j) Then, as shown in FIG. 7J, the opening of the $SiO_2$ film 101 is anisotropically dry etched again in the perpendicular direction to be 20 μm depth with the ICP dry etching device, for example, so as to form the second nozzle portion 11*b* that is a square hole.

Figure 8K:
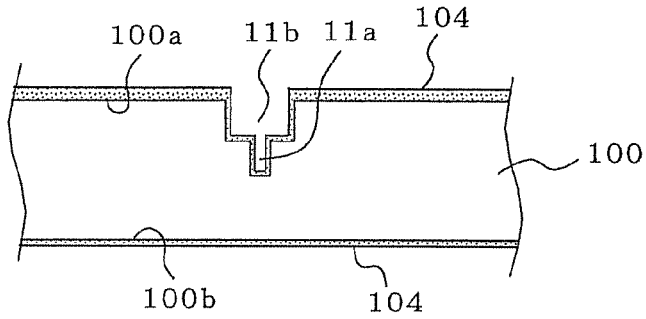
FIGS. 8K through 8O are partial sectional views showing steps for manufacturing the nozzle plate after FIG. 7J.

(k) Next, as shown in FIG. 8K, while the $SiO_2$ film 101 on the surface of the Si substrate in a step (j) above remains without being removed, the silicon substrate 100 is thermally oxidized so as to form a thermal oxide film ($SiO_2$ film) 104. The $SiO_2$ film 104 is formed on a whole surface of an inner wall of the nozzle hole 11 (the side and bottom surfaces of the first nozzle portion 11*a* and the second nozzle portion 11*b*) as a protection film. Here, the $SiO_2$ film 104 is formed by arranging the silicon substrate 100 in the thermal oxidation device and thermally oxidizing it at an oxidation temperature of 1000 degrees Celsius under an atmosphere of oxygen for three hours so as to form the $SiO_2$ film 104 having a thickness of 0.1 μm further on top of the whole surface of the silicon substrate 100 including the inner wall of the nozzle hole 11. Therefore, the $SiO_2$ film 104 on the surface of the silicon substrate is formed thicker than that of the inner wall of the nozzle hole 11.

Figure 8L:
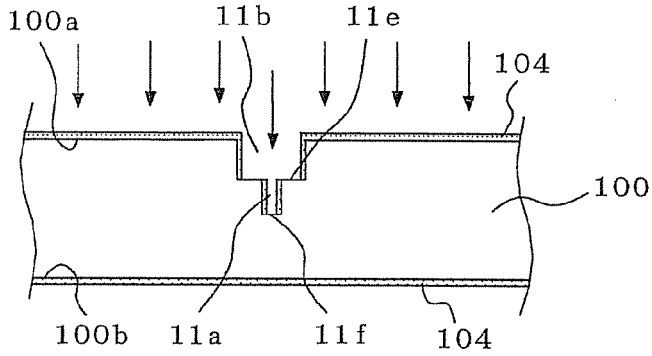

(l) Then, as shown in FIG. 8L, the $SiO_2$ film 104 on a bottom portion 11*f* of the first nozzle portion 11*a* and a stepped portion 11*e* are selectively removed by anisotropic dry etching with the RIE device. At this time, the $SiO_2$ film 104 on perpendicular sides of the first nozzle portion 11*a* are hardly eroded.

Figure 8M:
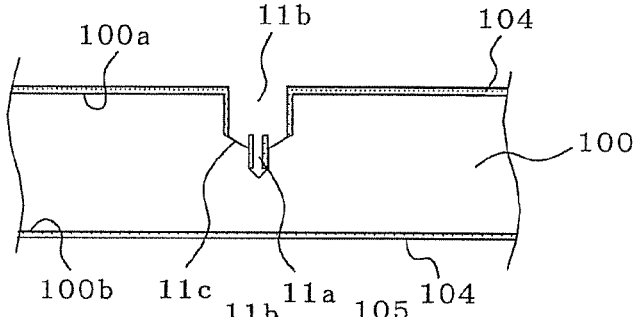

(m) Next, as shown in FIG. 8M, the silicon substrate 100 is anisotropically wet etched with a 25% TMAH aqueous solution so as to form the stepped portion 11*e* of the first nozzle portion 11*a* to be in an inverted pyramid shape. Thus, the inclined portion 11*c* is formed between the first nozzle portion 11*a* and the second nozzle portion 11*b*.

Figures 11A, 11B:
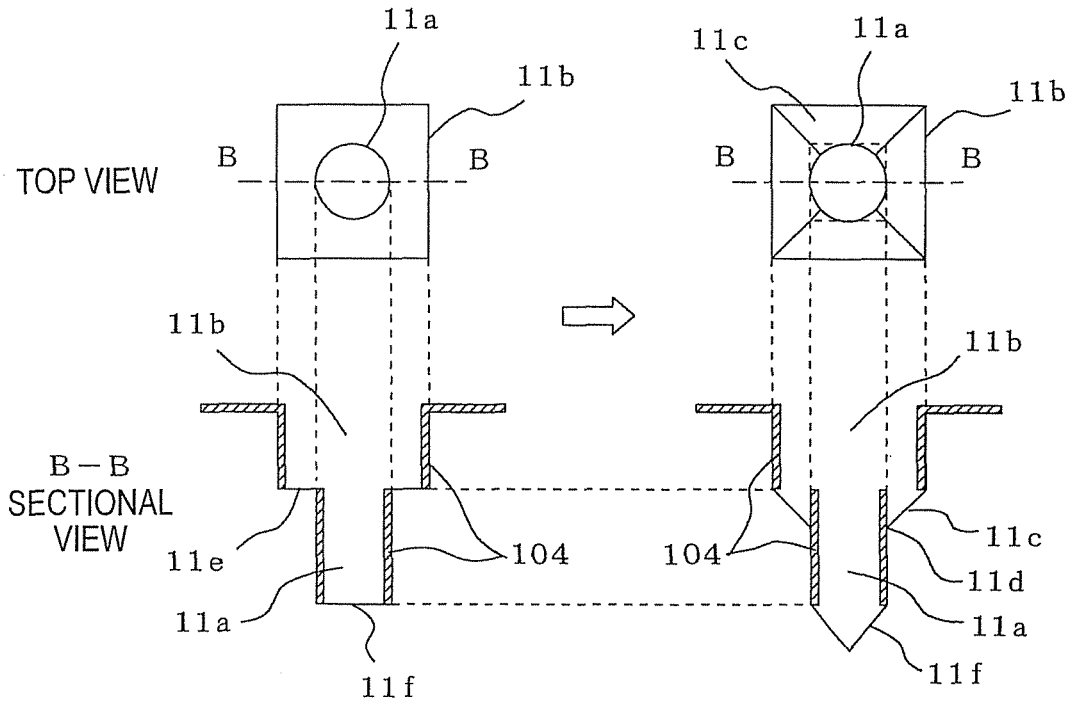
FIGS. 11A and 11B are diagrams explaining a nozzle shape in the steps shown in FIGS. 8L and 8M.

Here, further detailed explanation will be given with reference to FIGS. 11A through 12B. FIG. 11A indicates a top view (diagram above) and a sectional view (diagram below) taken along the line B-B showing the step (l) above, while FIG. 11B indicates a top view (diagram above) and a sectional view (diagram below) taken along the line B-B showing the step (m) above. However, in the top views, illustrations of the $SiO_2$ film 104 are omitted. Further, FIG. 12A is a diagram explaining a case where a method of the invention is performed on a nozzle in a shape according to related art, while FIG. 12B is a diagram explaining a nozzle in a shape according to the embodiment of the invention.

As shown in FIG. 11A, if anisotropic dry etching is performed on the nozzle hole 11, the $SiO_2$ film 104 only on the bottom portion 1 if of the first nozzle portion 11*a* and the stepped portion 11*e* are selectively removed. Next, as shown in FIG. 11B, if anisotropic wet etching is performed, the bottom portion 11*f* of the first nozzle portion 11*a* and the stepped portion 11*e* are etched in an oblique direction along the (100) surface orientation of the silicon so as to be in a inverted pyramid shape. The stepped portion 11*e* thus becomes the inclined portion 11*c* having the cross-sectional area gradually reducing from the second nozzle portion 11*b* to the first nozzle portion 11*a*. This nozzle shape is schematically shown in FIG. 12B. Compared with this, if the method according to the invention is applied to a nozzle in a shape according to related art (JP-A-11-28820 (FIGS. 3 and 4)), that is, if anisotropic wet etching is performed to a nozzle hole having the first nozzle portion 11*a*, a second nozzle portion 11*b*' that form a two-stage cylindrical shape, and a stepped portion 11*e*' after a $SiO_2$ film on the stepped portion 11*e*' has been removed, the stepped portion 11*e*' is processed to form an inverted pyramid shape. This is because that a tangential direction of a circle of the stepped portion 11*e*' is a (111) surface of the silicon, and thus the etching proceeds in directions of the sides and the four corners. Therefore, undercuts are generated at the four corners and a cross-sectional area of the nozzle is dramatically changed at the stepped portion 11*e'*. This disturbs an ink flow and causes a whirlpool or the like, resulting in unfavorable discharge characteristics.

According to the reason above, in the embodiment according to the invention, the second nozzle portion 11*b* is formed in a square hole shape from the beginning, preventing generation of undercuts as the above at the stepped portion 11*e*.

Referring back to FIG. 8N, the description will be continued.

Figure 8N:
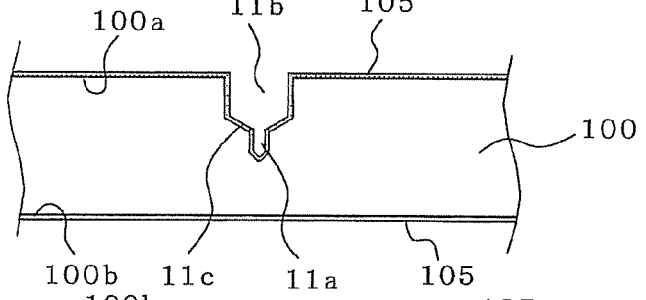

(n) As shown in FIG. 8N, all of the $SiO_2$ film 104 described above is removed with a hydrofluoric acid solution, and then again a thermal oxide film ($SiO_2$ film) 105 is formed to be in a thickness of 0.1 μm. Film forming conditions of the thermal oxide film 105 are the same as the conditions in the step (k) above.

Figure 8O:
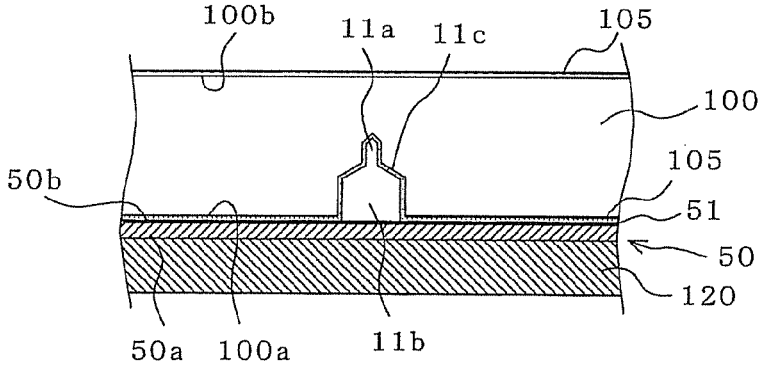

(o) Next, as shown in FIG. 8O (hereinafter up to FIG. 9R, the silicon substrate 100 shown in FIG. 8N will be shown upside down), a support substrate 120 made of a transparent material such as glass is bonded to the bonding surface 100*a* through a double-sided adhesive sheet 50. As the double-sided adhesive sheet 50, for example, Selfa BG (Registered Trademark: SEKISUI CHEMICAL CO, LTD.) is used. The double-sided adhesive sheet 50 is a sheet (self-removing sheet) having a self-removing layer 51, and has adhesive surfaces on the both sides. One of the adhesive surfaces is provided with the self-removing layer 51 whose adhesivity is reduced by a stimulus such as ultraviolet light or heat.

As the above, an adhesive surface 50*a* only having an adhesive surface of the double-sided adhesive sheet 50 is faced to a surface of the support substrate 120, while an adhesive surface 50*b* having the self-removing layer 51 of the double-sided adhesive sheet 50 is faced to the bonding surface 100*a* of the silicon substrate 100, and the these respective surfaces are bonded under a reduced pressure atmosphere (10 Pa or less) such as vacuum, for example. This can achieve favorable bonding without air bubbles remaining in the bonding interface. In a case where air bubbles remain in the bonding interface, thickness variation is caused to the silicon substrate 100 that is to be thinned by polishing. Further, since bonding the silicon substrate 100 and the support substrate 120 through the double-sided adhesive sheet 50 is simply required, unlike the related art, intrusion of a foreign material such as adhesive resin into the nozzle hole 11 of the silicon substrate 100 is not caused. Therefore, cracks and chipping caused when the double-sided adhesive sheet 50 is removed from the silicon substrate 100 will not occur to the silicon substrate 100, improving yield of the nozzle substrate 1 and resulting in significant improvement in productivity.

In the description above, a case where only one surface of the double-sided adhesive sheet 50 has the self-removing layer 51 is described, however both of the surfaces 50*a* and 50*b* of the double-sided adhesive sheet 50 may have the self-removing layer 51. In this case, when the silicon substrate 100 is processed to be thinned, the silicon substrate 100 can be processed in a state in which both of the surfaces 50*a* and 50*b* having a self-removing layer are respectively bonded to the silicon substrate 100 and the support substrate 120. Further, after the process, the silicon substrate 100 and the support substrate 120 are removed at the both of the surfaces 50*a* and 50*b* having a self-removing layer.

Figure 9P:
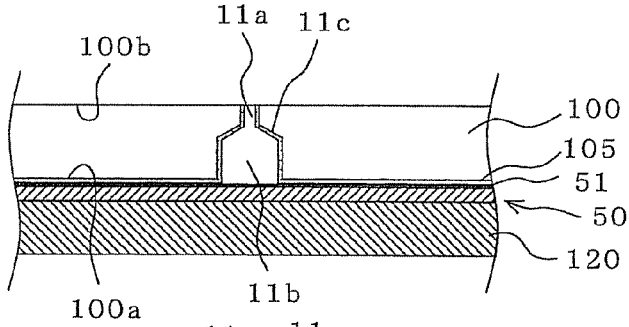
FIGS. 9P through 9T are partial sectional views showing steps for manufacturing the nozzle plate after FIG. 8O.

(p) Next, as shown in FIG. 9P, the ink discharge surface 100*b* of the silicon substrate 100 is ground with a back grinder (not shown) so as to thin the substrate 100 as far as that an end of the first nozzle portion 11*a* is opened. Further, the ink discharge surface 100*b* may be polished by a polisher, and/or CMP so as to open the end of the first nozzle portion 11*a*. At this time, the inner walls of the first nozzle portion 11*a* and the second nozzle portion 11*b* are cleaned in a water washing process for removing a polishing agent in the nozzle.

Alternatively, the end of the first nozzle portion 11*a* may be opened by dry etching. For example, the silicon substrate 100 can be thinned by dry etching using $SF_6$ as an etching gas until reaching the end of the first nozzle portion 11*a*, and followed by dry etching using an etching gas such as $CF_4$ or $CHF_3$ so as to remove the $SiO_2$ film 105 at the end of the first nozzle portion 11*a* that has been exposed to the surface.

Figure 9Q:
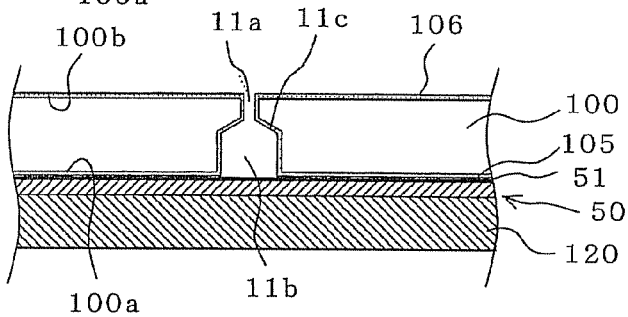

(q) Next, as shown in FIG. 9Q, a $SiO_2$ film 106 is formed on the ink discharge surface 100*b* of the silicon substrate 100 with a sputtering system so as to have a thickness of 0.1 μm. Here, the method to form the $SiO_2$ film 106 is not limited to sputtering, but any methods can be employed as long as they are performed under a temperature (about 200 degrees Celsius) in which the double-sided adhesive sheet 50 is not deteriorated, or less. However, considering an ink resistance property or the like, a dense film needs to be formed. Therefore, it is desirable to use an apparatus that can form a dense film at room temperature such as an ECR sputtering apparatus.

Figure 9R:
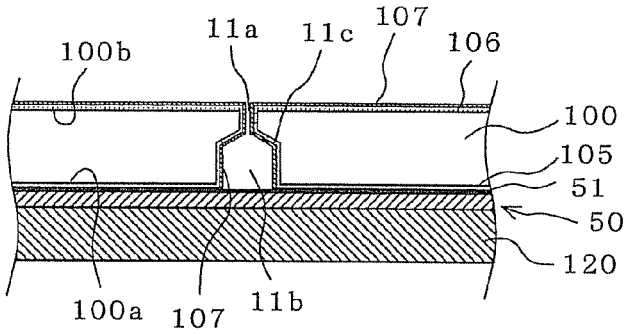

(r) Next, as shown in FIG. 9R, ink repellent is further processed to the ink discharge surface 100*b* of the silicon substrate 100. In this case, an ink-repellent layer 107 is formed by depositing a material having an ink repellent property and including F atoms by vapor-deposition or dipping. At this time, the ink repellent is also processed to the inner walls of the first nozzle portion 11*a* and the second nozzle portion 11*b*.

Figure 9S:
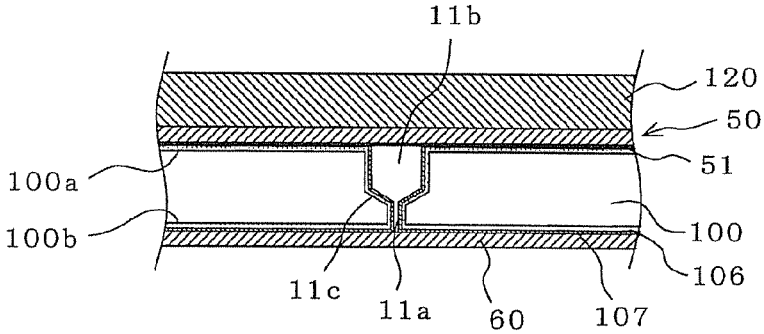
Figure 9T:
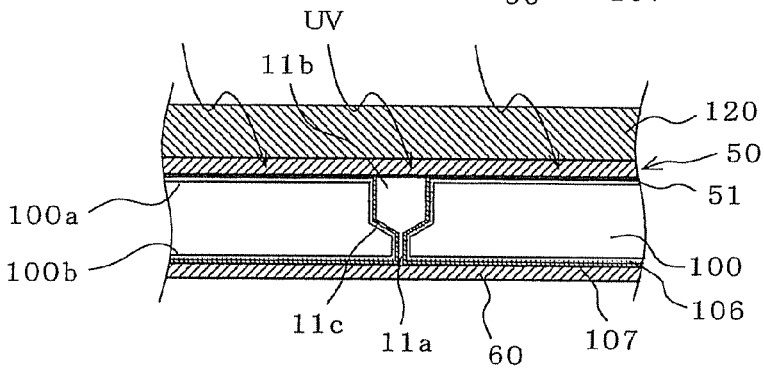
Figure 10U:
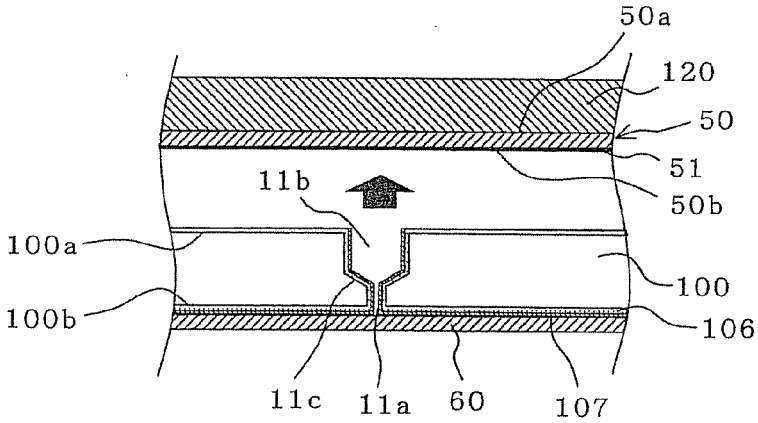
FIGS. 10U through 10X are partial sectional views showing steps for manufacturing the nozzle plate after FIG. 9T.

(s) Next, as shown in FIG. 9S (hereinafter up to FIG. 10V, the silicon substrate 100 shown in FIG. 9R will be shown upside down), a dicing tape 60 is attached to the ink discharge surface 100*b* to which ink repellent has been processed as a support tape. (t) Then, as shown in FIG. 9T, UV light is irradiated from the support substrate 120 side. (u) Accordingly, as shown in FIG. 10U, the self-removing layer 51 of the double-sided adhesive sheet 50 is exfoliated from the bonding surface 100*a* of the silicon substrate 100 so as to detach the support substrate 120 from the silicon substrate 100.

Figure 10V:
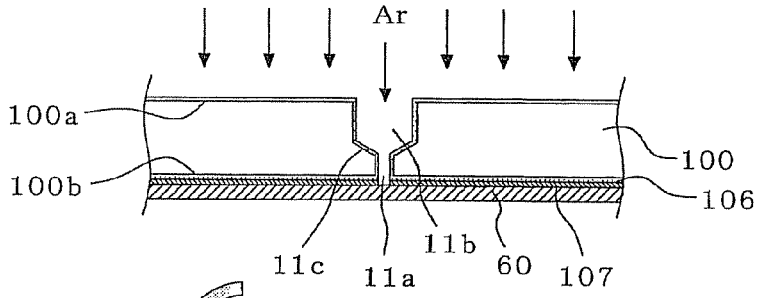

(v) Next, as shown in FIG. 10V, an excessive portion of the ink repellent layer 107 formed on the bonding surface 100*a* of the silicon substrate 100, and in the inner walls of the first nozzle portion 11*a* and the second nozzle portion 11*b* is removed by Ar sputtering or $O_2$ plasma treatment.

Figure 10W:
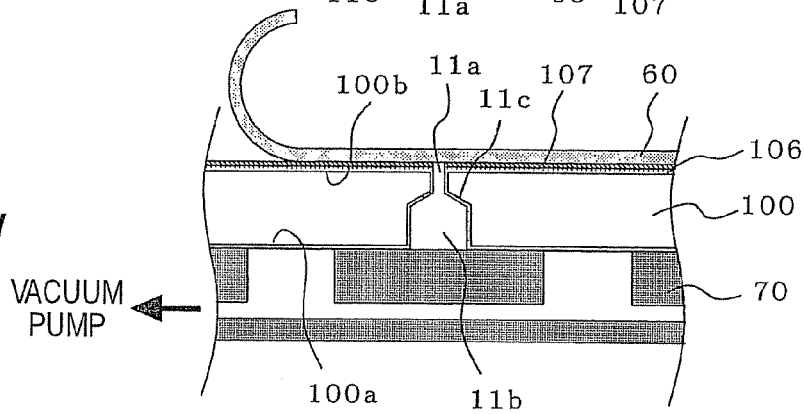

(w) Next, as shown in FIG. 10W (hereinafter up to FIG. 10X, the silicon substrate 100 shown in FIG. 10V will be shown upside down), the bonding surface 100*a* of the silicon substrate 100 (a surface located on an opposite side of the ink discharge surface 100*b* to which the dicing tape 60 has been attached) is secured to a suction jig 70 by suction, and then the dicing tape 60 that has been attached to the ink discharge surface 100*b* as a support tape is exfoliated.

Figure 10X:
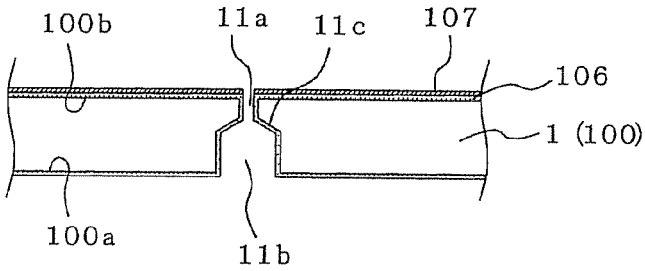

(x) In the end, as shown in FIG. 10X, immobilization by suction to the suction jig 70 is released so as to collect the nozzle substrate 1 from the silicon substrate 100.

Since the silicon substrate 100 has a groove outlining nozzle plates, the nozzle plate 1 is divided into individual pieces when being picked up from the suction jig 70.

Through the steps above, the nozzle plate 1 is formed from the silicon substrate 100. There may be a case where the self-removing layer 51 that has intruded into the nozzle remains and adheres to a ridge line of the nozzle of the bonding surface 100*a*, however, it is removable by cleaning with sulfuric acid or the like.

Next, a bonding surface of the cavity plate 2 is bonded to the bonding surface 100*a* of the nozzle substrate 1 formed as above (the bonding step is not illustrated).

Through the steps above, a bonded body of the nozzle plate 1 and the cavity plate 2 is formed.

Thereafter, in the bonded body formed from the nozzle plate 1 and the cavity plate 2, the other bonding surface of the cavity plate 2 is bonded to a bonding surface of the electrode plate 3 (the bonding step is not illustrated).

Through the steps above, a bonded body of the nozzle plate 1, the cavity plate 2, and the electrode plate 3 is formed, completing the inkjet head 10.

In the steps from FIGS. 7H through 8O, the first nozzle portion 11*a* is shown in a state not to penetrate through the silicon substrate 100, however, it may penetrate therethrough.

Further, the method for manufacturing a nozzle plate according to the embodiment can provide following advantageous effects.

(1) Since the first nozzle portion 11*a* in a cylindrical shape and the second nozzle portion 11*b* in a square hole shape are continuously formed by the inclined portion without having a stepped portion, both improvement in discharging characteristics and high densification of nozzles can be achieved.

(2) Since the inclined portion 11*c* is formed to be in an inverted pyramid shape having the second nozzle portion 11*b* in a square hole shape as an outer edge, shape control is facilitated.

(3) A step to form the stepped portion 11*e* simply needs to be added similarly to a step for processing a two-stage nozzle in related art using existing equipment, thereby not causing any additional investments to be required.

(4) Without requiring any masks or the like, the oxide film on the stepped portion and the bottom portion of the inner wall of the nozzle can be selectively removed.

(5) The oxide film with a favorable coverage can be formed on the inner wall of the nozzle.

Figure 13:
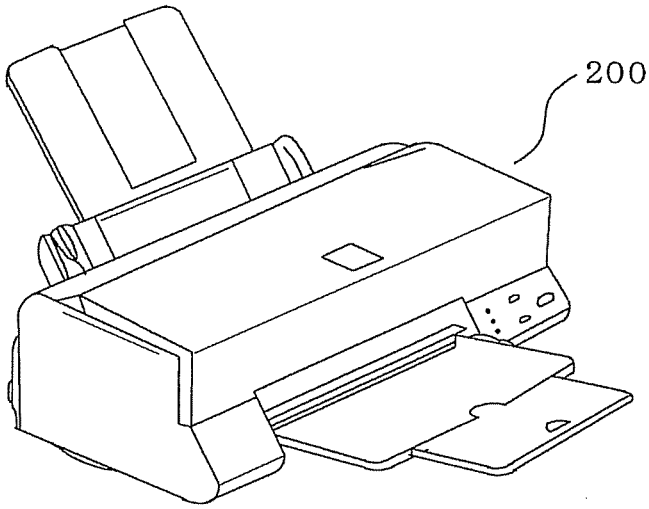
FIG. 13 is a perspective view showing an inkjet printer provided with the inkjet head according to the embodiment of the invention.

The above embodiment has described the nozzle plate and the inkjet head, as well as the method for manufacturing them. The invention, however, is not limited to the above embodiment. Various modifications can be made within the scope of idea of the invention. For example, by changing a liquid material discharged from the nozzle holes, other than an inkjet printer 200 shown in FIG. 13, it can be used as a droplet discharge device for various purposes, such as manufacturing of a color filter of a liquid crystal display, formation of a light emitting section of an organic EL display device and manufacturing a microarray of biomolecular solution used in gene testing or the like.

What is claimed is:

1. A nozzle plate, comprising:

a silicon substrate made of single crystal silicon having a (100) surface orientation; and a nozzle hole formed in the silicon substrate for discharging a liquid droplet including:

a first nozzle portion formed perpendicularly to a surface of the silicon substrate, the first nozzle portion having a first axis and a first cross-sectional area;

a second nozzle portion formed perpendicular to the surface of the silicon substrate in the vicinity of the first nozzle portion, the second nozzle portion having the first axis and a second cross-sectional area that is larger than the first cross-sectional area of the first nozzle portion; and an inclined portion formed between the first nozzle portion and the second nozzle portion, the inclined portion having a third cross-sectional area gradually increasing from the first nozzle portion to the second nozzle portion, wherein at least four sides among sides shaping the second cross-sectional area of the second nozzle portion are parallel to a (111) crystal orientation of the single crystal silicon.

2. The nozzle plate according to claim 1, wherein the second cross-sectional area and the third cross-sectional area are shaped in one of a square shape and a rectangular shape.

3. A droplet discharge head, comprising the nozzle plate according to claim 1.

4. A droplet discharge device, comprising the droplet discharge head according to claim 3.

5. The nozzle plate according to claim 1, wherein the second nozzle portion has a first opening at the surface of the silicon substrate, and the first opening and the second cross-sectional area are square shaped.

* * * * *